US010058863B2

(12) United States Patent
Hofmann et al.

(10) Patent No.: US 10,058,863 B2
(45) **Date of Patent: *Aug. 28, 2018**

(54) DEVICE FOR PERFORMING AN ASSAY

(75) Inventors: Oliver Hofmann, London (GB); Simon Rattle, Woking (GB)

(73) Assignee: MOLECULAR VISION LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/238,445

(22) PCT Filed: Aug. 10, 2012

(86) PCT No.: PCT/EP2012/065697

§ 371 (c)(1),
(2), (4) Date: May 27, 2014

(87) PCT Pub. No.: WO2013/024031

PCT Pub. Date: Feb. 21, 2013

(65) Prior Publication Data

US 2014/0271368 A1 Sep. 18, 2014

(30) Foreign Application Priority Data

Aug. 12, 2011 (GB) ..... 1113992.0

(51) Int. Cl.
*B01L 3/00* (2006.01)

(52) U.S. Cl.
CPC ..... *B01L 3/50273* (2013.01); *B01L 3/502707* (2013.01); *B01L 3/502738* (2013.01);
(Continued)

(58) Field of Classification Search
CPC ..... B01L 3/50273; B01L 3/502707; B01L 3/502738; B01L 3/502746;
(Continued)

(56) References Cited

U.S. PATENT DOCUMENTS 5,147,607 A * 9/1992 Mochida ..... B01J 19/0093 422/417
5,458,852 A 10/1995 Buechler et al.
(Continued)

FOREIGN PATENT DOCUMENTS

EP 2523001 11/2012
GB 2410086 7/2005
(Continued)

OTHER PUBLICATIONS

Great Britain search report dated Dec. 7, 2011 regarding Application No. GB1113992.0.

(Continued)

*Primary Examiner* — Lore R Jarrett
(74) *Attorney, Agent, or Firm* — McDonnell Boehnen Hubert & Berghoff LLP

(57) ABSTRACT

This invention relates to a device for performing an assay to detect an analyte in a fluid sample comprising a channel with reagent deposits comprising a flow control reagent positioned at one or more defined locations therein and a method for producing such a device. In particular, the invention relates to a microfluidic device.

29 Claims, 1 Drawing Sheet

(52) U.S. Cl.
CPC . *B01L 3/502746* (2013.01); *B01L 2200/0621* (2013.01); *B01L 2200/16* (2013.01); *B01L 2400/0406* (2013.01); *B01L 2400/0677* (2013.01); *B01L 2400/084* (2013.01); *B01L 2400/086* (2013.01)

(58) Field of Classification Search
CPC ..... B01L 2400/086; B01L 2400/084; B01L 2400/0406; B01L 2200/16; B01L 2200/0621; B01L 2400/0677
See application file for complete search history.

(56) References Cited

U.S. PATENT DOCUMENTS 6,019,944 A 2/2000 Buechler
6,130,098 A * 10/2000 Handique ..... B01F 5/0085 366/DIG. 2
6,379,929 B1 * 4/2002 Burns ..... B01J 19/0093 435/91.1
6,669,831 B2 12/2003 Chow et al.
6,767,510 B1 * 7/2004 Buechler ..... B01L 3/50273 422/412
7,338,760 B2 * 3/2008 Gong ..... B01L 3/5027 422/547
2002/0142618 A1 10/2002 Parce et al.
2002/0179445 A1 * 12/2002 Alajoki ..... B01J 19/0093 204/451
2003/0138819 A1 * 7/2003 Gong ..... B01L 3/5027 435/6.11
2004/0028566 A1 * 2/2004 Ko ..... B01L 3/502707 422/505
2004/0043507 A1 3/2004 Song et al.
2004/0115831 A1 * 6/2004 Meathrel ..... G01N 33/54366 436/514
2006/0207880 A1 9/2006 Joyce et al.
2007/0041869 A1 * 2/2007 Zimmer ..... B01L 3/502738 422/400
2008/0145948 A1 6/2008 Menon
2008/0213821 A1 9/2008 Liu et al.
2009/0081080 A1 * 3/2009 Meathrel ..... G01N 33/54366 422/400
2012/0028246 A1 2/2012 Nakaya et al.
2013/0011932 A1 1/2013 Itoh et al.
2014/0227707 A1 * 8/2014 Yager ..... B01L 3/5023 435/6.12

FOREIGN PATENT DOCUMENTS

GB 2463549 3/2010
JP 2009-031102 A 2/2009
WO 02/12856 A1 2/2002
WO 03/060157 7/2003
WO 03/072227 9/2003
WO 2004/083859 9/2004
WO 2007/002237 A1 1/2007
WO 2009/037361 A1 3/2009
WO 2009/139246 11/2009

OTHER PUBLICATIONS

International Search Report and Written Opinion dated Nov. 13, 2012 for International Application No. PCT/EP2012/065697, filed Aug. 10, 2012.

* cited by examiner

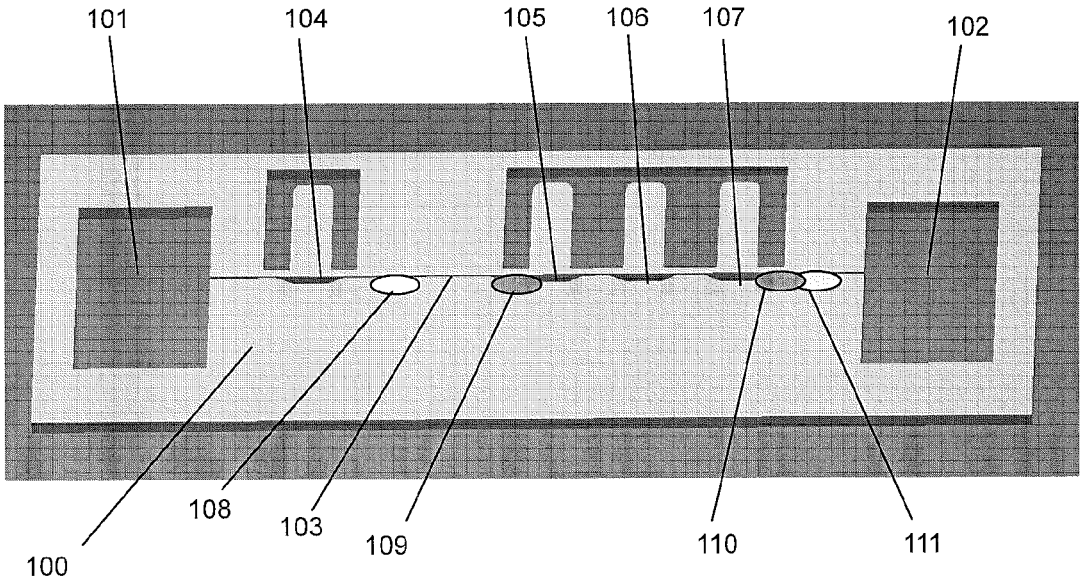
101
104
105
106
107
102
108
103
109
110
111
100

DEVICE FOR PERFORMING AN ASSAY

This application is a U.S. national phase application of International Patent Application No. PCT/EP2012/065697 filed on Aug. 10, 2012, which claims the benefit of Great Britain patent application 1113992.0, filed Aug. 12, 2011.

FIELD

This invention relates to a device for performing an assay to detect an analyte in a fluid sample comprising a channel with reagent deposits comprising a flow control reagent positioned at one or more defined locations therein and a method for producing such a device. In particular, the invention relates to a microfluidic device.

BACKGROUND

The accurate control of fluid flow in microfluidic devices is key to the ability to perform assays, for example diagnostic immunoassays, in a microfluidic device. Fluid flow can be achieved with actuated or passive microfluidics. Actuated microfluidics control fluid flow using an external power source or pump. In passive microfluidics fluid flow is encoded by the design of the microfluidic device itself, rather than externally applied forces, with fluid flow occurring due to capillary forces. Passive microfluidic devices, sometimes referred to as autonomous capillary systems, are attractive due to their low power consumption, portability and low dead volume.

The optimization of performance of assays conducted in microfluidic channels is dependent on control of the timings for the various steps of the assays. Frequently this is achieved by the incorporation of structural delay elements such as delay loops that take a controlled period of time to fill. Such an approach has numerous disadvantages such as the complexity of the channel design with attendant variation in performance arising from difficulties in achieving a uniform sealing of the channel, a limitation of the number of tests that can be placed within a certain area, by virtue of the space occupied by the delay loops, high flow resistance and viscous drag associated with relatively long channels of small cross-sectional area, and the high surface area:volume ratio that characterizes such a design which leads to inefficient clearance of reagent along the channel length.

It is therefore desirable to provide a device with a simplified structural design to overcome problems such as those mentioned above, but in which fluid flow can be controlled to an extent sufficient to allow optimization of assays performed therein.

It has now been determined that these problems can be overcome by control of fluid filling by chemical means, in particular by incorporating within the path of fluid flow in a device deposits of reagents that decrease or increase the rate of fluid flow as they are contacted by a flowing fluid front.

SUMMARY

According to a first aspect of this invention, there is provided a device for performing an assay comprising:

an inlet;

an outlet;

a channel extending between the inlet and the outlet;

at least one detection zone located at a position along the length of the channel, and at least one reagent deposit within the channel comprising a flow-control reagent, wherein the reagent deposit is arranged to increase or decrease the flow rate of a fluid flowing through the channel and to provide pick-up of the flow-control reagent by the fluid.

In an embodiment, the channel has at least one dimension of less than 5 mm.

In some embodiments of the invention, the channel is substantially linear.

The fluid is an aqueous fluid. The fluid may be a fluid sample comprising an unknown quantity of analyte for detection and optionally one or more additional components dissolved therein. In an embodiment of the invention, the reagent deposit is arranged to provide pick-up of the flow-control reagent by the fluid, wherein pick-up of reagent is achieved by rehydration or dissolution of reagent by the fluid or by digestion of reagent by an enzyme within the fluid. Accordingly, the flow-control reagent may be hydrophilic, water soluble and/or enzymatically degradable.

In an embodiment of the invention, pick-up of flow-control reagent by the fluid causes a bulk change in the flow properties of the fluid. This bulk change may be a bulk change in viscosity or surface tension of the fluid. This bulk change in flow properties of the fluid has the effect of either decreasing or increasing the rate of fluid flow within the channel.

Each reagent deposit may be present at a discrete, predetermined position within the channel. A reagent deposit is accordingly preferably located at a discrete position along the length of the channel, but does not extend along the entire length of the channel (at least a portion of the length of the channel has no reagent deposit). Preferably, where the device comprises two or more reagent deposits, each reagent deposit is at a discrete position, not in contact with another reagent deposit. Prior to use of the device by introduction of a fluid to carry out an assay, each reagent deposit is preferably a dry reagent deposit, comprising flow control reagent and optionally additional components, but substantially free from solvent.

In an embodiment of the invention, the flow-control reagent is a delay reagent or a speed-up reagent, wherein a delay reagent is a reagent which decreases the rate of flow of a fluid within the at least a portion of the channel and wherein a speed-up reagent is a reagent which increases the rate of flow of a fluid within at least a portion of the channel. In some embodiments, the device comprises two or more reagent deposits, each independently located at a separate predetermined position within the channel. In some embodiments, the device comprises two or more reagent deposits comprising a delay reagent and optionally at least one reagent deposit comprising a speed-up reagent. In other embodiments the device preferably comprises at least one reagent deposit comprising a delay reagent and a reagent deposit comprising a speed-up reagent. The reagent deposit (s) enable the rate of fluid flow through a single channel to be controlled, defining zones of fast and slow fluid flow within the channel. This enables one or multiple assays to be successfully performed within a single channel without the need to incorporate structural features, such as delay loops, within the channel to give sufficient residence times of a fluid sample. For example, a device with a single channel incorporating reagent deposits in accordance with the invention can be used to carry out tests for multiple analytes within a sample. Manufacturing complexity and costs are reduced and performance is enhanced compared to devices where structural features are utilised to control fluid flow. Accordingly, in an embodiment of the invention, the channel is substantially linear.

In an embodiment of the invention, the delay reagent is a reagent which decreases the rate of fluid flow within the channel by increasing the viscosity and/or density of a fluid. Accordingly, the delay reagent may be a viscosity enhancer, for example a hydrophilic polymer or cyclodextrin. Suitable hydrophilic polymers include cellulose derivatives (such as methyl cellulose, hydroxypropylmethylcellulose and hydroxyethyl cellulose), polypeptides, proteins (such as gelatin, albumin and globulin), polyethyleneoxide polymers (POLYOX™), and polysaccharides (such as dextran, glycogen, xanthan gum, alginates (e.g. sodium alginate), hyaluronates, pectin, chitosan, agarose and amylose). Further possible delay reagents include monosaccharides and disaccharides (such as glucose, mannose, galactose, altose, sucrose, lactose, trehalose and maltose), oligosaccharides and polypeptides. These delay reagents act by increasing density and/or viscosity of the fluid flow front. In an embodiment of the invention, the delay reagent is a cellulose derivative, for example methyl cellulose.

By use of the invention, it is possible to slow the rate of fluid flow through a channel without providing a physical barrier to block the flow path of a fluid. Fluid flow can be delayed without inducing a state where there is total impedance of flow. In contrast to the presence of a barrier blocking the flow path, (e.g by sealing the entire cross-section (width and depth) of a channel), delay of flow according to the invention can be achieved by a reagent deposit, where the deposit does not block the fluid flow path. It is advantageous to the performance of an assay in the device to achieve slowing of fluid flow whilst avoiding total impedance of fluid flow.

Accordingly, in some embodiments of the invention the device comprises a reagent deposit comprising delay reagent arranged to decrease the flow rate of a fluid flowing through the channel by altering the flow properties of a fluid, without blocking the fluid flow path.

In some embodiments at least one reagent deposit is provided as a layer (or film) of reagent on one or more channel surfaces. The layer is present as a coating on the surface, but does not block the flow path. The layer does not extend across the entire cross section of the channel. Preferably, at the position of the channel where the deposit is located, the deposit extends across ≤50%, ≤25%, or ≤10% of the cross-sectional area of the channel. In some embodiments, the deposit covers the entire lateral dimension of a channel surface at the position of the channel where the deposit is located. Preferably, the deposit is provided as a layer on the base of the channel, covering the entire width of the base of the channel at the location of the deposit. Deposit covering the entire lateral dimension (e.g. width) helps achieve consistent control of fluid flow avoiding fluid by-pass of the reagent deposit.

In an alternative embodiment, the delay reagent is a reagent which decreases the rate of fluid flow within the channel by providing a physical barrier to fluid flow. As the reagent is picked-up by the fluid the physical barrier is removed and fluid flow resumes. It will be appreciated that in some embodiments the delay reagent acts by both effecting a change in bulk flow properties of the fluid on pick-up of the reagent and providing a physical barrier to fluid flow prior to reagent pick-up.

Accordingly, in a further embodiment of the invention, a reagent deposit comprises delay reagent in the form of a three-dimensional plug which extends across at least a portion of the cross-section of the channel. The plug provides a physical barrier to fluid flow prior to reagent pick-up. Preferably, the three-dimensional plug extends across the entire cross-section of the microfluidic channel, thereby sealing the cross-section of the channel.

In an embodiment of the invention, the speed-up reagent is a reagent which increases the rate of fluid flow within the channel, for example by decreasing the surface tension of the fluid. The speed-up reagent may be a surfactant. Suitable surfactants include, but are not limited to, polyoxyethylene sorbitan esters (e.g. TWEEN™ surfactants), nonylphenol ethoxylate or secondary alcohol ethoxylates (e.g. TERGITOL™ surfactants), octylphenol ethoxylates (TRITON™ surfactants), polyoxyethylene fatty ethers (e.g. BRIJ surfactants) or a mixture thereof. In certain embodiments, the speed-up reagent is Triton X-100 or a mixture of Triton X-100 and BRIJ 98. A reagent deposit comprising a speed-up reagent can be provided as a thin-film of reagent on a channel surface, for example corresponding to the layer or a channel surface described above, or in the form of a three-dimensional plug which extends across at least a portion of the cross-section, or across the entire cross-section, of the channel.

Many assays require a washing step. Washing will be ineffective if fluid flows too slowly. Accordingly, the incorporation of a deposit of a speed-up reagent enables an increase in the rate of fluid flow to allow washing steps to be completed successfully.

In another embodiment of the invention, at least one reagent deposit further comprises a dried buffer composition. The dried buffer composition is rehydrated by the passage of a fluid through the channel, with the fluid picking up the components of the buffer composition. When rehydrated during use of the device, the buffer composition provides dynamic coating of channel surfaces to minimise non-specific binding of detection antibody or analyte thereto. This is beneficial for a device to be used in conducting high sensitivity assays.

The dried buffer composition may be formed by applying an aqueous buffer solution such as HEPES, phosphate, citrate, Tris, Bis-Tris, acetate, MOPS or CHAPS, comprising a protein (for example gelatin or an albumin such as bovine serum albumin, lactalbumin or ovalbumin) and a surfactant (such as Tween-20 or Triton X-100) solubilised therein and drying. Optionally the buffer composition additionally comprises a preservative (for example Proclin® or sodium azide). The buffer composition is typically in the pH range of 5.0-9.0. An exemplary composition comprises Bis-Tris buffer, bovine serum albumin (BSA) and a polyoxyethylene sorbitan ester surfactant (e.g.Tween-20). BSA acts to suppress non-specific binding by deposition on the channel surfaces, thus blocking the surfaces to non-specific binding. The pick-up of BSA could be seen as a dynamic passivation step to suppress non-specific binding.

In some embodiments, where the device comprises at least two reagent deposits, two or more reagent deposits (preferably each comprising delay reagent) are located between the detection zone closest to the outlet and the outlet, between two detection zones, or between the detection zone closest to the inlet and the inlet. In some embodiments, two or more reagent deposits comprising delay reagents between the detection zone closest to the outlet and the outlet. In some embodiments, a reagent deposit comprising speed-up reagent is also present, preferably between the detection zone closest to the outlet and the outlet.

The device may comprise two or more detection zones and a reagent deposit comprising a delay reagent located within the channel between the detection zones. This can be useful to provide a greater fluid residence time in one of the detection zones where, for example, greater incubation time is required.

In the device of the invention at least one detection zone is positioned along the length of the channel. The presence of more than one detection zone allows the device to be used to carry out multi-analyte serial testing on a sample. In an embodiment, the device defines a first detection zone and one or more additional detection zones. The first detection zone may be for carrying out a reference measurement and the one or more additional detection zones may be for probing for one or more analytes. Alternatively, all detection zones may be for probing for one or more analytes. Where the device is for carrying out an immunoassay and the first detection zone is for carrying out a reference measurement, a detection antibody deposit may be located between the first detection zone and the one or more additional detection zones and capture antibodies may be located within the one or more additional detection zones. In an example of this embodiment, a reagent deposit comprising a delay reagent may be positioned between the deposit of detection antibody and the one or more additional detection zones. Where the device is for carrying out an immunoassay and the first detection zone is for probing for an analyte, the device may comprise a deposit of detection antibody positioned within the channel between the inlet and the first detection zone. In an example of this embodiment, a reagent deposit comprising a delay reagent may be positioned within the channel between the deposit of detection antibody and the first detection zone. In another example, a reagent deposit comprising delay reagent is located between the detection zone closest to the outlet and the outlet. In these embodiments, additional delay reagent deposits may be positioned between the additional detection zones, where more than one additional detection zone is present.

In any of the embodiments described herein, the device may optionally also comprise a deposit of a speed-up reagent located between the detection zone closest to the outlet, and the outlet.

In another embodiment, the device comprises a monolithic substrate within which the inlet, outlet, channel and detection chambers are formed, and a seal. The microfluidic channel is defined by channel walls. A reagent deposit may be deposited on one or more channel walls at a discrete location along the length of the channel. The substrate may be formed of a thermoplastic, for example PMMA, polycarbonate, a polyolefin or polystyrene. The substrate may be injection moulded. In certain embodiments, the substrate is formed from a dye-doped material. This enables the substrate itself to act as an optical filter. The seal may be formed from a tape sealed by an adhesive or laser welding and may comprise, for example, the same material as the substrate. It will be appreciated that a variety of material choices could be made for both the substrate and seal.

In an embodiment of the invention, the device is a microfluidic device. The device is preferably a passive device.

In a further embodiment of the invention, the device additionally comprises a light source and a light detector. In certain embodiments, the light source is an organic or inorganic light emitting diode and the light detector is an organic or inorganic photodetector.

In a second aspect, the present invention provides a process for the production of a device, the process comprising:

(a) providing an injection moulded substrate defining an inlet; an outlet; a channel extending between the inlet and the outlet; and at least one detection zone located at a position along the length of the channel, and (b) applying an aqueous solution of a flow-control reagent to a position within the channel;

(c) drying to effect solvent evaporation and create a reagent deposit.

The solution of flow-control reagent may simply be a solution in water or additional components such as buffer components (e.g. Bis-Tris buffer) may be present.

Drying step (c) may be carried out, for example, by heating, optionally under vacuum, or by freeze-drying.

In the process of the second aspect of the invention drying in a vacuum oven ensures quick solvent evaporation. The drying process can result in a 3D-reagent plug, or a film of deposited reagent depending on the deposition procedure particularly the volume of reagent solution applied.

In an embodiment of the process of the invention, the process comprises the further steps of:

(d) depositing detection antibody at a position within the channel between the at least one detection zone and the inlet;

(e) providing a solid support with capture antibody immobilized thereon; and (f) transferring the solid support into the at least one detection zone.

The solid support may be, for example, beads, baffles, tubing, a scaffold or rods.

In an embodiment of the process of the invention, the process further comprises the step of providing the substrate with a seal. Sealing may be achieved, for example, by laser welding or lamination of the seal to the substrate.

Preferred features of the first aspect of the invention also apply to the second aspect mutatis mutandis. Accordingly, structural features of the device and identity and composition of the flow control reagents as described for the first aspect of the invention also apply to the second aspect of the invention.

BRIEF DESCRIPTION OF THE DRAWINGS

Specific embodiments of the invention are described below by way of example only and with reference to the accompanying drawings, in which:

FIG. 1 shows a plan view of a device according to the invention.

DETAILED DESCRIPTION

A microfluidic device according to the present invention comprises at least one microfluidic channel having at least one dimension of less than 5 mm, preferably less than 1 mm. The at least one dimension may be a cross-sectional dimension (i.e. channel depth or width) at any position along the length of the channel. It will be appreciated that other dimensions of the channel and device may exceed this value. Where the cross-section of the channel is referred to this is intended to mean the cross-section of the channel taken in a direction perpendicular to the direction of fluid flow (the fluid flow path) and also to the length of the channel which extends between the inlet and the outlet. Where the channel is linear the length of the channel corresponds to a line extending between the inlet and the outlet. A substantially linear channel is preferably one where no more than 10% of the length of the channel deviates from a line extending between the inlet and outlet.

A channel within a device of the invention is defined by internal surfaces, which can also be referred to as channel surfaces or walls. The channel defines a fluid flow path, between the inlet and outlet, corresponding to the length of the channel. At any point along the length of the channel, the channel has a width and depth. This may vary along the length of the channel. Each channel wall has a lateral dimension, which is the wall dimension perpendicular to the fluid flow path. This is also the dimension between the walls adjoining a particular wall. One of these walls may be referred to as the base, where the lateral dimension of the base in a direction perpendicular to the direction of fluid flow and/or the length of the channel is the width. The channel also has a depth, which is the cross-sectional channel dimension perpendicular to the width.

A passive microfluidic device is a microfluidic device in which fluid flow in the device is encoded by forces inherent to the structure and composition of the device and the composition of the fluid (i.e. capillary and wicking forces). In such devices external forces (such as pumping, application of an electric field or application of a pressure differentional) are not required to create fluid flow through the device. Thus, a passive microfluidic device of the invention preferably does not rely on externally applied forces to create fluid flow.

A fluid in the context used herein is an aqueous fluid, i.e. a fluid comprising water and optionally additional components such as an analyte for detection. A fluid in this context is taken to mean a liquid.

A delay reagent in the context used herein is, in some embodiments, a hydrophilic polymer or cyclodextrin. Exemplary hydrophilic polymers include cellulose derivatives. It will be understood that a cellulose derivative is a compound derived from cellulose, in which one or more (or preferably all) of the hydroxyl groups of the linked glucose units of cellulose has been replaced by a substituent. In some embodiments, hydroxyl is replaced by —OR, wherein R is, for example, an optionally substituted alkyl group, preferably an alkyl group (e.g. $C_{1-6}$ alkyl) optionally substituted with one or more hydroxyl or carboxyl groups. Exemplary cellulose derivatives include methylcellulose, hydroxypropylmethylcellulose and hydroxyethylcellulose. A hydrophilic polymer delay reagent may also be, for example, a cellulose derivatives (such as methyl cellulose, hydroxypropylmethylcellulose and hydroxyethyl cellulose), polypeptides, proteins (such as gelatin, albumin and globulin), polyethyleneoxide polymers (POLYOX™), and polysaccharides (such as dextran, glycogen, xanthan gum, alginates (e.g. sodium alginate), hyaluronates, pectin, chitosan, agarose and amylose).

As used herein, an oligosaccharide contains 3 to 20 sugar residues. Larger oligosaccharides, containing 11 or more residues are preferred for use as a delay reagent. A polysaccharide contains 21 or more sugar residues. A polypeptide (including proteins) preferably contains more than 20 amino acid residues. It will be appreciated that a polypeptide (or protein) may be glycosylated and/or phosphorylated. Generally, a polymer is taken to be a compound comprising 21 or more monomeric units.

Exemplary speed-up reagents according to the invention include BRIJ® and TRITON® surfactants. As is well known in the art, BRIJ® surfactants are polyoxyethylene fatty ethers. These can be generally represented by the formula $R—[OCH_2CH_2]_n—OH$, where R is alkyl and n is 2 or more. In some embodiments, R may be $C_{12-18}$ alkyl and n may be 2 to 100. For example, BRIJ 98 corresponds to polyoxyethylene(20)oleyl ether, where R is $C_{18}H_{35}$ and n is 20.

As is well known in the art, TRITON® surfactants are octylphenol ethoxylates and TERGITOL® surfactants are nonylphenol ethoxylates and secondary alcohol ethoxylates. Phenol ethoxylates can be generally represented by the formula:

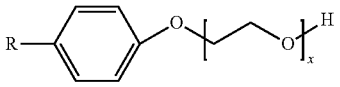

wherein R is octyl (octylphenol ethoxylates) or nonyl (nonylphenol ethoxylates). x represents the ethoxylate repeat unit and is 2 or more, for example 4-70. For example, in Triton X-100, x is 9-10.

In the context used herein, a detection antibody is an antibody which is labelled, directly or indirectly, with an entity that can be measured, e.g. by optical or electrochemical means and a capture antibody is an antibody which can be immobilised within a detection zone (e.g. on a solid support). Both the detection antibody and capture antibody are capable of binding to an analyte for detection.

In overview, a fluid sample for testing, containing an unknown quantity of an analyte, is placed in an inlet reservoir. A fluid sample may range, for example, from aqueous buffer systems (e.g. Bis-Tris buffer) to urine, serum or plasma or filtered whole blood. Sample fluid is drawn via an inlet, for example by capillarity, into a channel. Placing of fluid within the inlet reservoir may induce a small pressure differential within the device. Any pressure differential (or hydrostatic force) created by introduction of a sample fluid into the device is not considered an externally applied force in the context of this disclosure. Thus, where the device is a passive device preferably no additional external pressure differential is applied. The sample fluid passes through the channel by capillarity to the outlet, and flows through the outlet into an outlet reservoir, by wicking. Probing to allow analyte detection may be conducted at one or more points along the channel. These points are referred to herein as detection zones. As the fluid encounters the one or more reagent deposits it picks up the flow control reagents contained therein. According to the choice of flow control reagent, this causes either a change in bulk flow properties of the fluid to delay or speed up fluid flow, and/or the reagent deposit provides a physical barrier to delay flow, with flow being resumed as the reagent is picked up by the fluid, removing the barrier. The presence of reagent deposits allows the residence time of fluid to be controlled within defined portions of the channel. This can be used, for example, to extend residence time in portions of the channel where incubation with antibodies is required and/or analyte detection occurs, or to speed up flow where required to achieve washing.

A detection zone is a chamber defined by a discrete portion of the microfluidic channel. The detection zone is in fluid communication with the channel and preferably the portion of the channel defining a detection zone has a cross-sectional dimension greater than the corresponding cross-sectional dimension of the adjoining portions of the channel. Probing, for example optical probing, may be carried out on sample fluid within a detection zone. In one embodiment, a light source is utilized to emit light into the detection zone and a light detector is utilized to detect light emission, such as fluorescence or phosphorescence by an optically active material within the sample fluid. The optically active material may be an optically active reagent which binds directly or indirectly to the analyte or competes with the analyte for binding to another reagent. A detection zone may be a reference detection zone, in which a reference measurement such as a background light measurement may be taken.

In some embodiments described herein, a flow control reagent is a water soluble reagent. In the context of this disclosure, a water soluble reagent is a reagent that can be solubilised in water.

It will be appreciated that solubility varies dependent on temperature, but in the context used herein a reagent is considered water soluble if at room temperature or on application of heat up to the boiling point of water, an amount of the reagent can be solubilised in liquid water. If heating is used to aid solubilisation, the reagent should be able to remain in solution on cooling to room temperature.

In some embodiments described herein, a flow control reagent is an enzymatically degradable reagent. In such embodiments, in addition to the analyte the fluid may comprise an enzyme capable of digesting the flow control reagent. Examples include a proteolytic enzyme used with a protein flow control reagent such as gelatin, albumin or globulin (for use in non-antibody assays) or an enzyme capable of digesting a polysaccharide, for example dextranase with dextran or amylase with amylose or starch.

The skilled person will understand that all references to optical and light are made by way of example only and the present disclosure extends to cover other parts of the electromagnetic spectrum. For example, the device in accordance with the present invention is equally suitable for infrared probing using an infrared source and/or infrared detector. In addition, detection techniques other than optional detection can be employed.

A microfluidic device according to the invention can be used to perform assays to allow detection of an analyte within a fluid sample. Detection techniques are applicable to methods of specific-binding assays for quantitatively or qualitatively assaying analytes. For the avoidance of doubt, "analyte" refers to the species under assay and "specific binding partner" refers to a species to which the analyte will bind specifically.

Examples of analytes and specific binding partners which may be used are given below. In each case, either of the pair may be regarded as the analyte with the other as the specific binding partner: antigen and antibody; hormone and hormone receptor; polynucleotide strand and complementary polynucleotide strand; avidin and biotin; protein A and immunoglobulin; enzyme and enzyme cofactor (substrate); lectin and specific carbohydrate.

Embodiments may relate to a form of immunoassay known as a 2-site immunometric assay. In such assays, the analyte is "sandwiched" between two antibodies, one of which (the detection antibody) is labelled, directly or indirectly, with an entity that can be measured, e.g. by optical or electrochemical means, and the other antibody (the capture antibody) is immobilised, directly or indirectly, on a solid support.

The skilled person will understand that the present invention is equally applicable to analyses other than in vitro diagnostics, for example environmental, veterinary and food analysis.

It can also be understood that the invention is equally applicable to heterogeneous or homogeneous immunoassays, fluorescent dye binding assays and other assay formats.

In summary, the present disclosure relates to a device in which the rate of fluid flow can be controlled within a single channel, thereby enabling the performance of an assay or multiple assays therein, without the need for structural features, such as delay loops, to control the rate of fluid flow.

An embodiment of a microfluidic device of the invention is illustrated in FIG. 1. The device comprises an inlet reservoir 101, an outlet reservoir 102 and a microfluidic channel 103. These structural features are formed within an injection moulded substrate 100. It will be appreciated that any optically clear thermoplastic material compatible with injection moulding could be used to form the substrate, for example polystyrene, polycarbonate, a polyester, polymethyl methacrylate or a polyolefin (for example a cyclic polyolefin such as TOPAS).

Four detection zones are positioned along the length of the channel. Each detection zone comprises a cavity which physically interconnects with the microfluidic channel 103 to define a volume of space for receiving sample fluid. The first detection zone 104 is provided to carry out a reference measurement, such as a background light measurement. The second, third and fourth detection zones 105, 106 and 107 each contain a solid support, such as beads or rods, with a capture antibody bound thereto. In the embodiment illustrated in FIG. 1, the second, third and fourth detection zones 105, 106 and 107 contain beads or rods with capture antibodies bound thereto, the capture antibodies being specific for analytes for detection (in the case of a cardiac assay, the cardiac markers troponin I, CK-MB and myoglobin, respectively). It should be appreciated that the identity of the capture antibodies can be varied to allow detection of different markers within a sample. A deposit of a detection antibody 108 (a labelled antibody) is positioned between the first detection zone 104 and the second detection zone 105.

The device of the invention, as exemplified by the device illustrated in FIG. 1, can utilise different detection antibodies to assay for different analytes. A solid support, such as beads or rods, coated with the respective capture antibodies for the analyte to be detected can be deposited in the second, third and fourth detection zones 105, 106, 107, respectively. Detection antibodies (labelled) for all three of the targeted analytes (markers) are deposited before the second detection zone 105 (either in separate zones or one combined zone with a mix of all three detection antibodies). The assay sequence can then be summarised as follows:

1. deposition of detection antibodies (for targeted markers) between first and second detection zones
2. transfer of pre-prepared dry solid support with bound capture antibody into second, third and fourth zones detection
3. sealing of chip with pressure sensitive tape
4. placement of wick into outlet reservoir
5. loading of sample into inlet reservoir; capillarity then initiates assay which is run autonomously without requiring further user intervention.

A deposit of a delay reagent 109 is present on a plateau located between the detection antibody 108 and the second detection zone 105, adjacent the second detection zone 105. The deposit of delay reagent 109 can also be located within the channel 103, not immediately adjacent the second detection zone 105, but between the detection antibody 108 and the second detection zone 105. The deposit of the delay reagent 109 is for instance a plug of methylcellulose.

The microfluidic device as illustrated in FIG. 1 was produced by injection moulding of PMMA to form a substrate 100 defining the sample inlet 101, outlet 102 and microfluidic channel 103. The methyl cellulose plug was produced by depositing 3 μL of 1.0% (w/v) methyl cellulose (4,000 cP for a 2.0% (w/v) solution) into the channel and drying in a vacuum oven for 30 mins. This deposition protocol, with fast drying under vacuum, yields a reagent plug 109 covering the entire cross section of the channel, once sealed, as opposed to conventional drying which would lead to a reagent deposit as a film on one surface of the channel only. Plug adhesion to the channel is important and can be assisted by the provision of a textured surface as part of the injection moulding process or by scoring the surface after injection moulding.

Flow rates were assessed in an exemplary device of the structure as illustrated in FIG. 1, in which the channel 103 was 49 mm long, 2 mm wide and 0.2 mm deep. In the four detection zones (3 mm long, 2 mm wide) the depth increases to 1 mm. The first detection zone 104 and the second detection zone 105 are 11 mm apart: This section is used for deposition of detection antibodies and first delay reagent (for pre-incubation). The second to fourth detection zones 105, 106 and 107 are separated by 2 mm long lane sections. The distance from the end of the fourth detection zone 107 to the outlet 102 is 5 mm. This section is used for the deposition of the second flow delay reagent zone to ensure binding to the capture antibody in the specific zones before wicking is initiated.

Filling times for the device without the use of a delay reagent or speed-up reagent were determined. Using an injection moulded PMMA device and a surfactant system (0.1% (w/v) Triton-X 100, 1.0% (w/v) BRIJ in Bis-Tris buffer), typical filling times of inlet to outlet of ~1 min were observed. By removing Triton X-100 and changing the BRIJ 98 concentration from 1 to 0.5-0.1% (w/v), filling times were extended to 3, 4 and 6 minutes, respectively. However, to carry out a targeted cardiac marker assay for Troponin I, CK-MB and myoglobin, overall residence times of ~15 minutes are needed to allow for pre-incubation of sample with detection antibody and binding of pre-bound sample-detection antibody complex to capture antibody (bound to solid support) in the detection zones. To allow the assay to function successfully, residence times of ~5 minutes from the inlet to the second detection zone are ideally required followed by incubation in the detection zones for 8 min. After incubation over the detection zones, quick filling of the final segment of the microfluidic channel, between the fourth detection zone and the outlet needs to be ensured to initiate wicking with excess sample to remove unbound detection antibody.

A reference measurement is taken as the fluid flow reaches the first detection zone 104. When the fluid flow front reaches the methyl cellulose plug 109 the fluid sample slowly rehydrates the plug, with the methyl cellulose being dissolved into the fluid. Dissolution of methyl cellulose into the fluid increases viscosity at the fluid flow front, resulting in a downstream slow down of fluid flow.

The flow front then fills the second, third and fourth detection zones 105, 106 and 107, holding respective capture antibody for Troponin I, CK-MB and Myoglobin. After filling of the fourth detection zone 107, second delay reagent deposit 110 is reached and again a delay is induced. This second delay defines the incubation time of sample in the detection zones. This needs to be in the order of several minutes, for the cardiac marker panel the preferred time is 8 min. To then ensure that filling of the last channel segment occurs, deposition of speed-up reagent 111 may be provided. In the most simplistic form this can be a surfactant such as Triton-X 100. To this end 1 μL of 0.2 to 0.8% (w/v) Triton-X 100 with or without BRIJ 98 in Bis-Tris buffer has been deposited, followed by drying. When the flow front passes over this speed-up zone, the surfactant concentration at the flow front increases, hence facilitating filling and reducing time-to-wick, resulting in earlier initiation of rinsing. Both delay and speed-up reagents can be deposited and dried at the same time.

In a second embodiment of a device of the invention, two reagent deposits comprising delay reagent were deposited in series. By reference to the device architecture shown in FIG. 1, the second embodiment can be described as follows. Two reagent deposits of methyl cellulose were produced by depositing 1 μL of 2.0% (w/v) methyl cellulose at channel positions 110 and 111. Special care was taken to spread the deposited solution across the entire width of the channel and ensure contact with the side walls. Incomplete coverage can result in full or partial by-passing of the delay zone by the flow front. Drying of the deposited layer in a vacuum oven for 30 mins yields the formation of a delay reagent film at the bottom of the channel only. Formation of a film as opposed to a plug as described in the previously defined embodiment is influenced by the deposition from protocol, in particular the volume of deposited solution. Flow front passing over the zones is slowed down by the slow dissolution of the deposited reagent and the associated viscosity enhancement. By having two delay zones in series the delay can be increased in a controlled and reproducible way to achieve high assay incubation times as required for some assays. The presence of two reagent deposits in series was found in this embodiment to be advantageous over a single reagent deposit of higher methyl cellulose concentration in avoiding complete stoppage of flow and enabling proper chip filling and assay completion. With the dual delay zone approach and 0.1% BRIJ 98 in Bis-Tris buffer filling times to outlet were extended from ~7 to over 11 minutes, with an associated incubation time increase in the fourth detection zone from ~1 to over 5 minutes.

As in the previously described embodiment, adhesion of the reagent deposit to the channel is important and can be assisted by provision of a textured channel surface as part of an injection moulding process or by scoring a channel surface after injection moulding.

Protocol for Device Preparation

A summary of an exemplary procedure that can be used to prepare a microfluidic device of the invention is the following:

(1) injection moulded substrate provided;

(2) flow delay reagents and, if required, speed-up reagents deposited into appropriate locations; e.g. 1 to 3 μl of 1 to 2% (w/v) methyl cellulose for flow delay and 1 μL of 0.2-0.8% (w/v) surfactant (Brij 98 or Triton X-100) for speed-up reagent in Bis-Tris buffer or water; dried in vacuum oven at 37° C. for 1 hour;

(3) deposition of detection antibody in appropriate locations;

(4) covalent immobilisation of capture antibody onto optically clear glass or plastic beads or rods;

(5) bead or rod transfer into detection zones;

(6) polyolefin tape with pressure sensitive adhesive placed on structured microchannel side of substrate which is then passed through roller laminator for pressure activation;

(7) assembled device ready to use (stored in desiccator or dry pouches until use).

Embodiments of the invention have been described by way of example only. It will be appreciated that variations of the described embodiments may be made which are still within the scope of the invention.

The invention claimed is:

1. A device for performing an assay comprising:

an inlet;

an outlet;

a channel extending between the inlet and the outlet;

a plurality of detection zones, each located at a position along the length of the channel, and a plurality of dry reagent deposits, each including a flow control reagent, each separately located within the channel at a different position along the length of the channel, each flow control reagent being hydrophilic, water soluble, and/or enzymatically degradable, and configured to be picked up by an aqueous fluid flowing through the channel so as to cause a substantial change in the bulk flow properties of the aqueous fluid, wherein the plurality of dry reagent deposits comprises a first reagent deposit, the flow control reagent of the first reagent deposit being a delay reagent, the first reagent deposit being located within the channel between two of the plurality of detection zones, and a second reagent deposit, the second reagent deposit being located within the channel between one of the plurality of detection zones and the outlet, wherein the delay reagent of the first reagent deposit is configured to decrease the rate of flow of the aqueous fluid within the channel.

2. The device of claim 1, wherein the channel has at least one dimension of less than 5 mm.

3. The device of claim 1, wherein the plurality of reagent deposits further comprises one or more additional reagent deposits, each of the one or more additional reagent deposits including as its flow control reagent a further delay reagent or a speed-up reagent, wherein the speed-up reagent is a reagent which increases the rate of flow of a fluid within at least a portion of the channel.

4. The device of claim 3, wherein the speed-up reagent is configured to increase the rate of fluid flow by decreasing the surface tension of the fluid.

5. The device of claim 4, wherein the speed-up reagent comprises a surfactant or a mixture of surfactants.

6. The device of claim 5, wherein the speed-up reagent is a surfactant selected from polyoxyethylene sorbitan esters, nonylphenol ethoxylate or secondary alcohol ethoxylates, octylphenol ethoxylates, polyoxyethylene fatty ethers and mixtures thereof.

7. The device of claim 3, wherein at least one of the additional reagent deposits comprises a speed-up reagent located within the channel between the further delay reagent and the outlet.

8. The device of claim 3, wherein each delay reagent is a reagent which is configured to decrease the rate of fluid flow within the channel by increasing the viscosity of a fluid, the density of a fluid or both the viscosity and the density of a fluid; and each speed-up reagent is configured to increase the rate of fluid flow by decreasing the surface tension of a fluid.

9. The device of claim 1, wherein the delay reagent is a reagent which is configured to decrease the rate of fluid flow within the channel by increasing the viscosity of the aqueous fluid, the density of the aqueous fluid or both the viscosity and the density of the aqueous fluid.

10. The device of claim 1, wherein the delay reagent is a reagent configured to decrease the rate of fluid flow within the channel by increasing the viscosity of the aqueous fluid.

11. The device of claim 1, wherein the delay reagent is a hydrophilic polymer.

12. The device of claim 1, wherein the delay reagent is independently selected from:

(a) a hydrophilic polymer selected from the group consisting of cellulose derivatives, polypeptides, proteins, polyethyleneoxide polymers, and polysaccharides;

(b) a cyclodextrin; and (c) a monosaccharide or disaccharide, oligosaccharide or polypeptide, or any mixture thereof.

13. The device of claim 1, wherein at least one of the reagent deposits comprises a delay reagent arranged to decrease a flow rate of the aqueous fluid flowing through the channel by altering the flow properties of the fluid, without blocking the fluid flow path.

14. The device of claim 1, wherein the channel is defined by channel surfaces, and at least one of the reagent deposits comprises a layer of reagent on one or more channel surfaces, wherein the layer does not extend across the entire cross-section of the channel.

15. The device of claim 1, wherein the delay reagent is in the form of a three-dimensional plug which extends across at least a portion of the cross-section of the channel.

16. The device of claim 1, wherein the channel is substantially linear.

17. The device of claim 1, wherein the device comprises a monolithic substrate within which the inlet, the outlet, the channel and the two or more detection zones are formed, and a seal.

18. The device of claim 1, wherein the device is a passive microfluidic device.

19. The device of claim 1, wherein the device additionally comprises a light source and a light detector.

20. A process for the production of a device, the process comprising:

(a) providing an injection molded substrate defining an inlet; an outlet; a channel extending between the inlet and the outlet; and a plurality of detection zones, each located at a position along the length of the channel, and (b) depositing a delay reagent at a position within the channel between two of the plurality of detection zones, thereby forming a first reagent deposit, and depositing a second flow control reagent at a position within the channel between one of the plurality of detection zones and the outlet, thereby forming a second reagent deposit, and (c) drying the device to effect solvent evaporation, wherein the process produces a device according to claim 1.

21. The process of claim 20, wherein the process further comprises:

(d) depositing detection antibody at a position within the channel between the two of the plurality of detection zones and the inlet;

(e) providing a solid support with capture antibody immobilized thereon; and (f) transferring the solid support into the at least one detection zone.

22. The process of claim 21, wherein the solid support comprises beads, baffles, tubing, a scaffold or rods.

23. The process of claim 20, further comprises providing the substrate with a seal.

24. The device of claim 1, wherein the plurality of detection zones and the plurality of reagent deposits are arranged in series along the channel between the inlet and the outlet.

25. The device of claim 1, wherein the first reagent deposit is in the form of a three-dimensional plug which extends across at least a portion of a cross-section of the channel.

26. The device of claim 1, further comprising a deposit of a detection antibody within the channel between said two of the plurality of detection zones.

27. The device of claim 26, wherein the deposit of the detection antibody is located between the first reagent deposit and the inlet.

28. The device of claim 1, wherein two or more reagent deposits are located between the detection zone closest to the outlet and the outlet.

29. The device of claim 1, wherein the delay reagent is configured to be picked up by the aqueous fluid by being dissolved in the aqueous fluid.

* * * * *